United States Patent [19]

DeLong

[11] 4,052,101

[45] * Oct. 4, 1977

[54] STADIUM RISER INDIVIDUAL SEAT, SUPPORT AND ARMREST WITH COMMON SEAT-ROW BACKREST

[76] Inventor: David C. DeLong, 1221 Broad St., Grinnell, Iowa 50112

[ * ] Notice: The portion of the term of this patent subsequent to Dec. 2, 1993, has been disclaimed.

[21] Appl. No.: 737,681

[22] Filed: Nov. 1, 1976

Related U.S. Application Data

[63] Continuation-in-part of Ser. No. 593,767, July 7, 1975, Pat. No. 3,989,299.

[51] Int. Cl.[2] ..... A47C 7/54; A47C 1/12

[52] U.S. Cl. ..... 297/243; 297/411; 297/248

[58] Field of Search ..... 297/248, 232, 243, 331, 297/335, 411, 422, 160, 450; 248/235; 52/8, 9

[56] References Cited

U.S. PATENT DOCUMENTS

| | | | |
|---|---|---|---|
| 2,186,866 | 1/1940 | Hussey | 52/8 X |
| 2,987,111 | 6/1961 | Walworth | 52/9 |
| 3,077,364 | 2/1963 | Eppink | 297/248 |
| 3,157,916 | 11/1964 | Puestow | 52/8 |
| 3,241,884 | 3/1966 | Thatcher et al. | 297/243 X |
| 3,301,597 | 1/1967 | Bereday | 297/422 X |
| 3,554,142 | 1/1971 | Sorenson | 248/235 X |
| 3,634,925 | 1/1972 | Van Loo | 297/411 |
| 3,850,476 | 11/1974 | Day | 297/335 |
| 3,960,405 | 6/1976 | DeLong | 297/248 |
| 3,989,299 | 11/1976 | DeLong | 297/411 |

*Primary Examiner*—Francis K. Zugel
*Attorney, Agent, or Firm*—Warren H. Kintzinger

[57] ABSTRACT

A combination individual seat mounting and arm rest support with continuous set row backrest for concrete stadium riser installation.

7 Claims, 7 Drawing Figures

STADIUM RISER INDIVIDUAL SEAT, SUPPORT AND ARMREST WITH COMMON SEAT-ROW BACKREST

Figure 1:
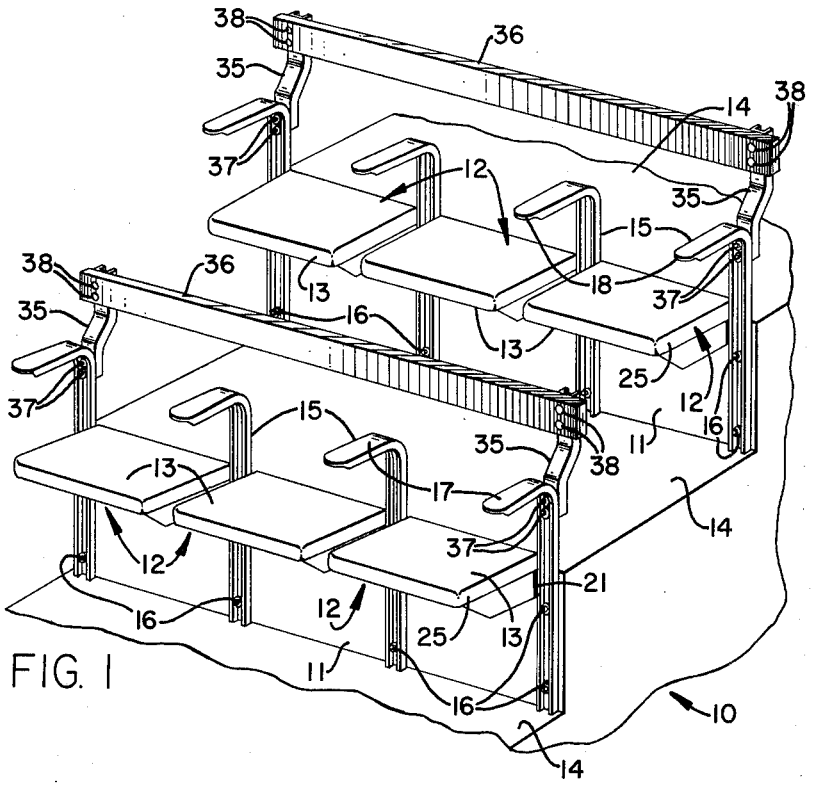

This application is a continuation-in-part of my copending application, Ser. No. 593,767, filed July 7, 1975 now U.S. Pat. No. 3,989,299.

This invention relates in general to stadium seating, and in particular to a seat row with individual seats having a combination seat support and arm rest seating mount and sharing a continuously extending common seat backrest member, the structure being useful as an upgrading installation on concrete stadium risers.

Replacement of bench seating in existing concrete stadiums is called for as older seating weathers and causes the need for considerable maintenance — repairs and replacement of the old seating. When the need for replacement arises, for many installations upgrading of the seating is also desired. Another consideration is that of expense, yet various people, such as school administrators, want to do something with their existing stadiums, for booster clubs and/or alumini, such as would be provided by improved stadium reserved seat sections.

It is therefore a principal object of this invention to provide improved individual seats in concrete stadiums.

Another object is to provide such individual seating as a replacement for stadium bench seating.

A further object is to provide individual seating with simple provision for a common seat-row shared backrest.

Still another object is to provide individual, stationary, fixed stadium seats separated by arm rests mounted on concrete risers.

Features of this invention useful in accomplishing the above objects include, in a concrete stadium riser backless seat, combination support and arm rest, U-shaped in section channel members vertically mounted to the vertical face of stadium risers, such as in a concrete riser equipped stadium, by bolt nuts on studs. The U-shaped channel members are formed over at their upper ends to form forwardly extended arm rests at each side of each individual seat, and between adjoining seats. Structural angle members bonded to the U-shaped channel members (as by welding) project forward to support seats bolted on the tops thereof at the bottom of each seat side. Backrest support members, affixed to and extending upwardly from the vertical extending portions of predetermined ones of the U-shaped channel members, serve as mounting supports for a common row extending backrest member.

A specific embodiment representing what is presently regarded as the best mode of carrying out the invention is illustrated in the accompanying drawing.

Figure 2:
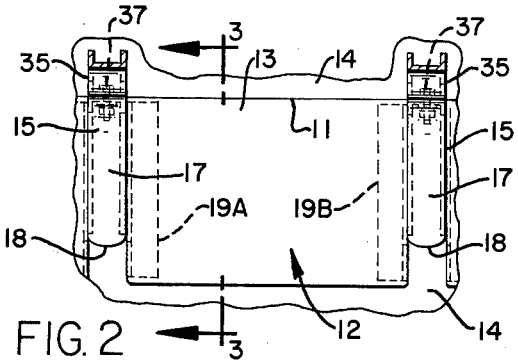
Figure 3:
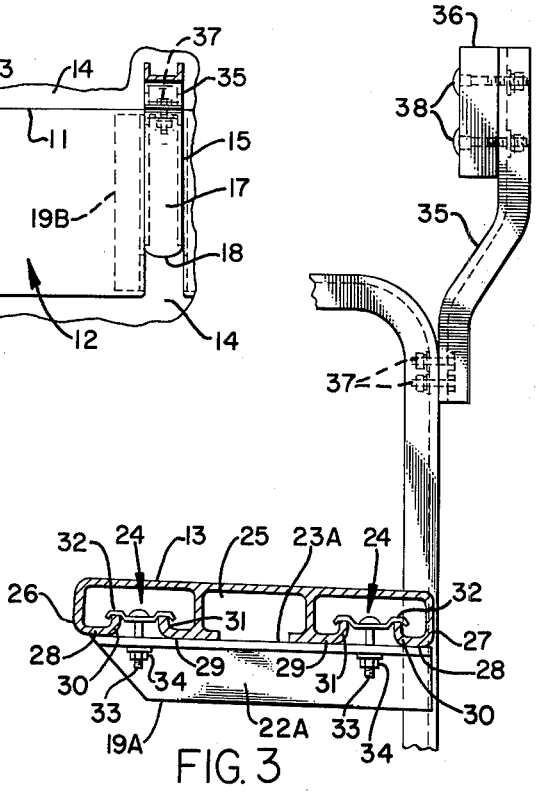
Figure 4:
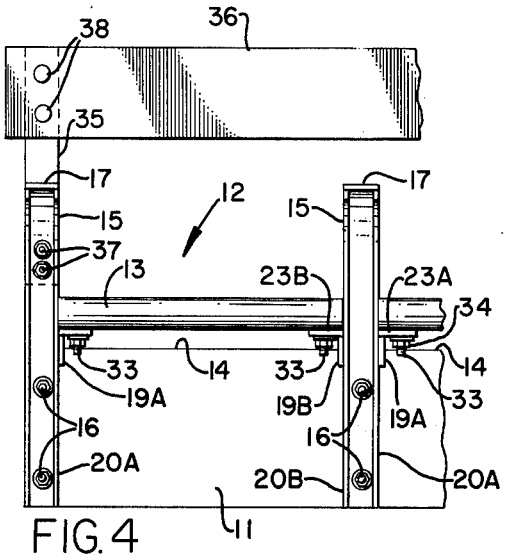
Figure 5:
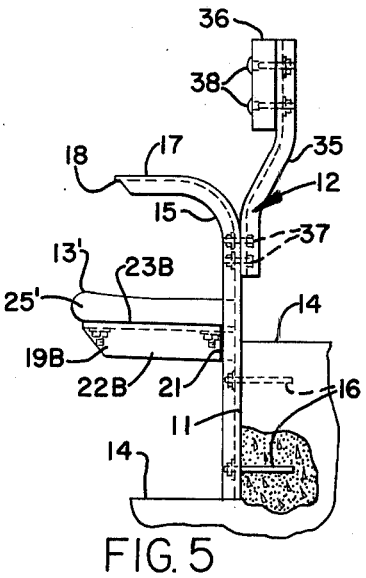
Figure 6:
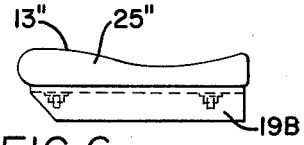
Figure 7:
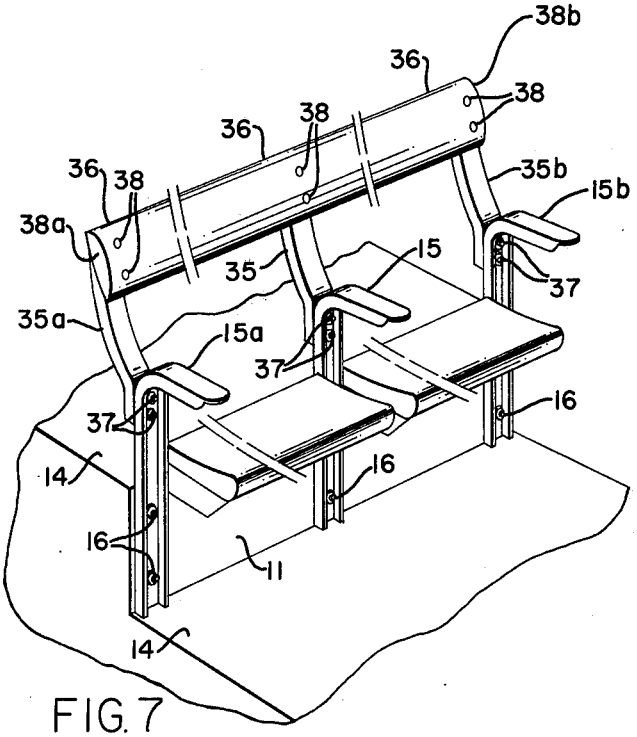

In the drawing:

FIG. 1 represents a partial perspective of a stadium section equipped with seat rows of the invention mounted on concrete stadium risers;

FIG. 2, a top plan view of an individual seat mounted on a stadium riser;

FIG. 3, an enlarged partial side elevation section view taken along line 3—3 of FIG. 2;

FIG. 4, a partial front elevation view of the stadium seating;

FIG. 5, side elevation view of a stadium seat;

FIG. 6, a partial side elevation view of a seat with a contoured seat installed instead of the semi-contoured seat used with the stadium seat of FIG. 5; and FIG. 7, a partial perspective of a stadium seat row.

Referring to the drawing:

The stadium section 10 of FIG. 1 is shown to be a multiple riser 11 structured concrete stadium such as may have previously been equipped with bench seating, but now is equipped with individual stationary seats 12. The seat bottoms 13 are individually mounted to project forwardly above and out from the mounting riser 11, over respective stadium riser step surfaces 14. The individual stationary seats 12 are fixed in place with U-shaped channel members 15 vertically mounted to the vertical face of stadium risers 11 by a plurality of nut and stud assemblies 16 anchor-embedded in concrete of the stadium seating risers 11.

Seat backrest support members 35 are shown mounted to row end defining ones of the U-shaped channel members 15 by nut and bolt assemblies 37, so as to extend generally upwardly from the vertically extending portions of the U-shaped channel members above the seat bottoms 13. Each seat row (here depicted as being three seats in length) shares a common seat backrest member 36 which extends transversely of the backrest support members 35 and is affixed to the upper extremes of the support members 35 by nut and bolt assemblies 38.

It is not necessary that a backrest support member extend from each of the U-shaped channel members in a seat row. Generally, as depicted in FIG. 7, the respective row end ones 15A and 15B carry backrest support members 35A and 35B, with such predetermined intermediate ones of channel members 15 carrying backrest support members 35 as is consistent with mounting symmetry in a row and structural integrity. It is preferably contemplated that two or three seats separate successive ones of the seat backrest support members 35 in a row. In general the support members 35 may be separated by a number of seats which corresponds to a factor of the number of seats in a row, to provide a symmetrical row structure including seat back support members on the row ends.

Referring to FIGS. 2, 3, 4, and 5, the seat backrest support members 35 may comprise U-shaped channels of stock common to the channels, 15, and affixed to U-shaped channels 15 with the respective channel webs abutted.

The seat backrest members 36 may comprise wood planking, or preferably, extruded aluminum members, with or without contouring as desired. As depicted in FIG. 7, seat backrest members 36 might comprise hollow extruded aluminum members with backside open longitudinally extending channel or channels, with turned-in lips similar to the structure depicted for the seat bottom of FIG. 3, in which case they might be mounted by bolt and clip assemblies (similar to those of FIG. 3) to the respective seat backrest support members 35, with the seat row ends thereof closed by respective end cap members 36A and 36B. By employing hollow channeled backrest extrusions and employing the channel insert expansion joint techniques as described in my U.S. Pat. No. 3,960,405, it is contemplated that the seat backrest member 36 need not be a continuous unitary expanse over a row length, but rather may comprise stock lengths not necessarily corresponding to row length or a defined spacing between backrest support members 35.

Referring again to FIGS. 2, 3, 4, and 5, the U-shaped channel members 15 are formed over in almost a right angle bend to extend forward at the channel tops as armrests 17 at the seat sides, and as a common armrest between adjacent seats. The U-shape of the channel members 15 faces forward, away from the stadium riser 11 vertical step faces, and downward in the armrest portions. This advantageously protects the otherwise exposed portions of the channel member 15 mounting nut and stud assemblies 16. The channel sides of channel members 15, at the forward end 18 of the armrests 17 are cut back at an angle and corners are rounded, along with end 18, to minimize catching and cutting of clothing and accidental injury to stadium users. Seat bottom 13 mounting, opposite angled structural angle members 19A and 19B, are bonded to channel sides 20A and 20B, respectively, of channel members 15, as by weldments 21. Structural angle members 19A and 19B are mounted at a small back-to-front upward slope to mount seat bottoms 13, 13' of FIG. 5, or 13" of FIG. 6 for optimized user comfort. The sides 22A and 22B of angle members 19A and 19B are cut back at an angle and edges are rounded just like with the armrests 17 of channel members 15. The flange tops 23A and 23B of each cooperating pair of angle members 19A and 19B mounts a seat bottom 13, 13', or 13" with bolt-clip assemblies 24. Individual seat bottoms 13 are box-like structures having end closure caps 25, and are equipped with bottom open underside channels 26 and 27 extended transversely from side to side across each seat bottom 13. Each of the underside channels 26 and 27 has bottom outer and inner lips or webbs 28 and 29 with upturned edge extensions 30 and 31. Clips 32, shaped to fit over the tops of the edge extensions 30 and 31 and span the space therebetween, are used as part of bolt-clip assemblies 24 used for securing the seat bottoms 13 in place on flange tops 23A and 23B. Bolts 33 of bolt-clip assemblies 24 extend to nuts 34 through the clips 32 and respective flange tops 23A and 23B.

It is of interest to note that angle members 19A and 19B mount the individual seat bottoms 13, 13' or 13" high enough above the stadium riser step surface 14, immediately therebehind to present an opening for water flow down from one riser step to the next lower riser step. This minimizes the retention of rain water in puddles behind seats in outside stadiums and/or facilities the hosing wash-down of stadiums. A semi-contoured seat 13' such as shown in FIG. 5, having substantially the same hold down mounting structure as with the more box-like seat of FIGS. 1 through 4, may be used. In like manner, the more fully contoured seat 13" of FIG. 6 could be used. Aluminum U-shaped channel members 15 with structural angle aluminum members 19A and 19B welded thereto are being used to mount fixed-position aluminum seat bottoms 13 or 13' or 13" in providing long life, substantially maintenance-free, upgraded stadium individual seating.

Whereas this invention is here illustrated and described with respect to several embodiments hereof, it should be realized that various changes may be made without departing from the essential contributions to the art made by the teachings hereof.

I claim:

1. In step riser mounted seating: a plurality of rowed individual seat means including, first structural members adapted to be mounted, in space-separated paralleled relationship, to the upright face of a step riser at each side of a seat; individual seat bottom means adapted for being mounted between and by pairs of successive adjacent ones of said first structural members; said first structural members being extended transversely above and below said individual seat bottom means mounted thereby; with the upper longitudinally extending portions of said structural members formed over by substantially ninety degrees, so as to coextend with, and be substantially parallel to, said seat bottom means, to provide armrest sections above and to each side of said individual seat bottom means; each of said first structural members being a continuous expanse of U-shaped channel, with the exterior surface of the channel web adapted to be juxtaposed with, and mounted to, the upright vertical face of a step riser; with such channel web exterior surface presenting upward facing armrest surfacing; a plurality of seat back support structural members, individual ones of which are affixed to and extended upwardly from the transversely extended portions of predetermined ones of said first structural members; and, a continuously extending seat backrest member extending transversely of and affixed to each of said back support structural members.

2. The seat structure of claim 1, wherein said channel members are each mountable to the upright vertical facing of a concrete stadium by a plurality of stud and nut assemblies, with the studs extended through through-holes in said channel web and anchored in concrete of the stadium step riser structure.

3. The seat structure of claim 2, wherein the mounting of said individual seat bottom means includes structural angle members attached to said channel members to extend out from the channel members and away from the step riser to which the respective channel members are mountable; and fastening means for fixedly mounting individual seat bottom means in place on respective pairs of said structural angle members.

4. The seat structure of claim 3, wherein individual seat bottom means are mounted higher than the upper surface of the stadium step riser mounting respective seats.

5. The seat structure of claim 3, wherein individual seat bottom means are bolted down at four corners to respective pairs of said structural angle means.

6. The seat structure of claim 3, wherein said individual seat bottom means include underside bottom open underside channel means having inner lip means; and a plurality of bolt-clip assembly means engaging said inner lip means of the channel means and extended through respective pairs of said structural angle means to secure the individual seat bottom means in place.

7. The seat structure of claim 6, wherein said individual seat bottom means underside bottom open underside channel means are at least two channels extended transversely from side to side across each seat bottom; and with end cap means closing each side end of individual seat bottoms.

* * * * *